US007134439B2

(12) United States Patent
Ramet

(10) Patent No.: US 7,134,439 B2
(45) Date of Patent: Nov. 14, 2006

(54) COMB AND METHOD FOR ISOLATING AT LEAST ONE LOCK OF HAIR

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 11/012,488

(22) Filed: Dec. 16, 2004

(65) Prior Publication Data

US 2005/0139225 A1 Jun. 30, 2005

Related U.S. Application Data

(60) Provisional application No. 60/539,121, filed on Jan. 27, 2004.

(30) Foreign Application Priority Data

Dec. 19, 2003 (FR) ..... 03 51150

(51) Int. Cl.
*A45D 24/00* (2006.01)

(52) U.S. Cl. ..... 132/160; 132/270

(58) Field of Classification Search ..... 132/160, 132/161, 270, 208; D28/21, 28–32
See application file for complete search history.

(56) References Cited

U.S. PATENT DOCUMENTS 1,035,411 A * 8/1912 Blunkali ..... 132/149
1,553,684 A * 9/1925 Gerberich ..... 292/348
2,175,344 A 10/1939 Friedman
2,598,330 A * 5/1952 Wilson ..... 132/117
2,915,071 A * 12/1959 Watkins ..... 132/213.1
3,205,903 A * 9/1965 Avanzo ..... 132/139
3,840,031 A 10/1974 Walker
4,993,438 A 2/1991 Hunt
4,996,996 A 3/1991 Hirsh
5,152,306 A 10/1992 Stephan
5,231,999 A * 8/1993 Schroettner ..... 132/137

FOREIGN PATENT DOCUMENTS

DE 811 603 8/1951
FR 1 600 472 9/1970

* cited by examiner

*Primary Examiner*—Cris L. Rodriguez
*Assistant Examiner*—Rachel A. Running
(74) *Attorney, Agent, or Firm*—Oliff & Berridge, PLC

(57) ABSTRACT

A hair comb may include a succession of teeth having at least one tooth that bears a hook, and at least two teeth without hooks. The hook may extend at least in part beyond a plane that is defined by at least two teeth in the succession.

51 Claims, 3 Drawing Sheets

COMB AND METHOD FOR ISOLATING AT LEAST ONE LOCK OF HAIR

CROSS-REFERENCE TO RELATED APPLICATIONS

This non-provisional application claims the benefit of French Application No. 03 51150 filed on Dec. 19, 2003 and U.S. Provisional Application No. 60/539,121 filed on Jan. 27, 2004, the entire disclosures of which are incorporated by reference herein.

BACKGROUND

The present invention relates to combs that can be used for isolating one or more locks of hair, so that a dyeing or highlighting product, for example, can be applied to the one or more isolated locks of hair.

French patent No. 1 600 472 and U.S. Pat. Nos. 4,993,438, 4,996,996 and 5,152,306 describe such combs.

There is a need for making it even easier to dye or add highlights to locks of hair, in particular for a single individual.

There is also a need for dyeing or adding highlights to locks in a manner that can be repeated over the whole head of hair.

SUMMARY

Exemplary embodiments of the invention provide a hair comb that includes a succession of teeth, having at least one tooth that bears a hook, said hook extending at least in part beyond a plane that is defined by at least two teeth in the succession. The succession of teeth may include, for example, at least two teeth, each of which bears a hook, or even at least three teeth each of which bears a hook. At least two teeth may be without any hooks.

Such a comb may make it easy to catch hold of and isolate one or more locks of hair in order to treat the one or more locks of hair.

Exemplary embodiments of the invention provide a comb that is relatively inexpensive to make, and therefore suitable for being marketed as part of a kit in conjunction with a hair treatment product.

In exemplary embodiments, the hooks may extend on one side of the succession of teeth and toward one lateral end of the comb.

The teeth may have bases that are in alignment.

A base of at least one tooth that bears a hook may be separated from a base of a consecutive tooth without a hook by a distance that is twice, or even three times, an average spacing between tips of two teeth without hooks.

In exemplary embodiments, the comb may include a handle that projects along a longitudinal axis. The succession of teeth may extend across the longitudinal axis. For example, the succession of teeth may extend along an axis that is perpendicular to the longitudinal axis.

In exemplary embodiments, the succession of teeth may comprise teeth having bases that extend in a manner that is not coplanar with the handle. For example, the bases of the teeth may make a non-zero acute angle with the longitudinal axis of said handle. Such a configuration may make the comb more ergonomic, for example. The non-zero acute angle may lie in a range of about 5° to about 45°, for example.

In embodiments that include such an acute angle, at least one hook may lie on a same side as said acute angle. Preferably, all the hooks may lie on said same side.

In exemplary embodiments, the comb may have a first succession of hooks that lie on one side of the plane and a second succession of hooks that lie on an opposite side of the plane. For example, the second succession may comprise only a single hook.

In such embodiments, the hooks of the first succession may all be directed toward a same lateral end of the comb, for example. The hooks of the second succession may be directed toward an opposite lateral end.

A spacing between two adjacent hooks within the first succession may be different from a spacing between two adjacent hooks within the second succession.

For example, the presence of a first succession of hooks and a second succession of hooks may enable a user to extract a different number of locks or locks that contain different amounts of hair, depending on which side of the comb is selected for application to the hair.

Exemplary embodiments of the invention provide a hair comb that comprises a succession of teeth having at least one tooth that bears a hook, said hook extending at least in part beyond a first plane that is defined by at least two teeth in the succession, and beyond a second plane which is perpendicular to said first plane.

Exemplary embodiments of the invention provide a hair comb that comprises a succession of teeth having at least two teeth that bear a hook, said hook extending at least in part beyond a plane that is defined by at least two teeth in the succession, said two teeth that bear a hook being separated by at least one teeth without hook.

Exemplary embodiments of the invention provide a method of dyeing or adding highlights to at least one lock of hair. The method may comprise: isolating at least one lock of hair by using a comb as defined above; and adding highlights to or dyeing the at least one lock thereby isolated.

In exemplary embodiments, the comb is used to isolate a plurality of locks simultaneously.

In order to isolate one or more locks, it is possible, for example, in a first step, to comb the hair using the comb in a conventional manner. Then, in a second step, the comb may be laid against the hair with the hook(s) placed against or beside the scalp, close to the roots of the hair. In a third step, the comb may be moved by drawing the handle backward, so that one or more locks become engaged in the hook(s).

BRIEF DESCRIPTION OF THE DRAWINGS

The invention will be better understood on reading the following detailed description of embodiments given as non-limiting examples, and on examining the accompanying drawings, in which.

DETAILED DESCRIPTION OF EMBODIMENTS

Figure 1:
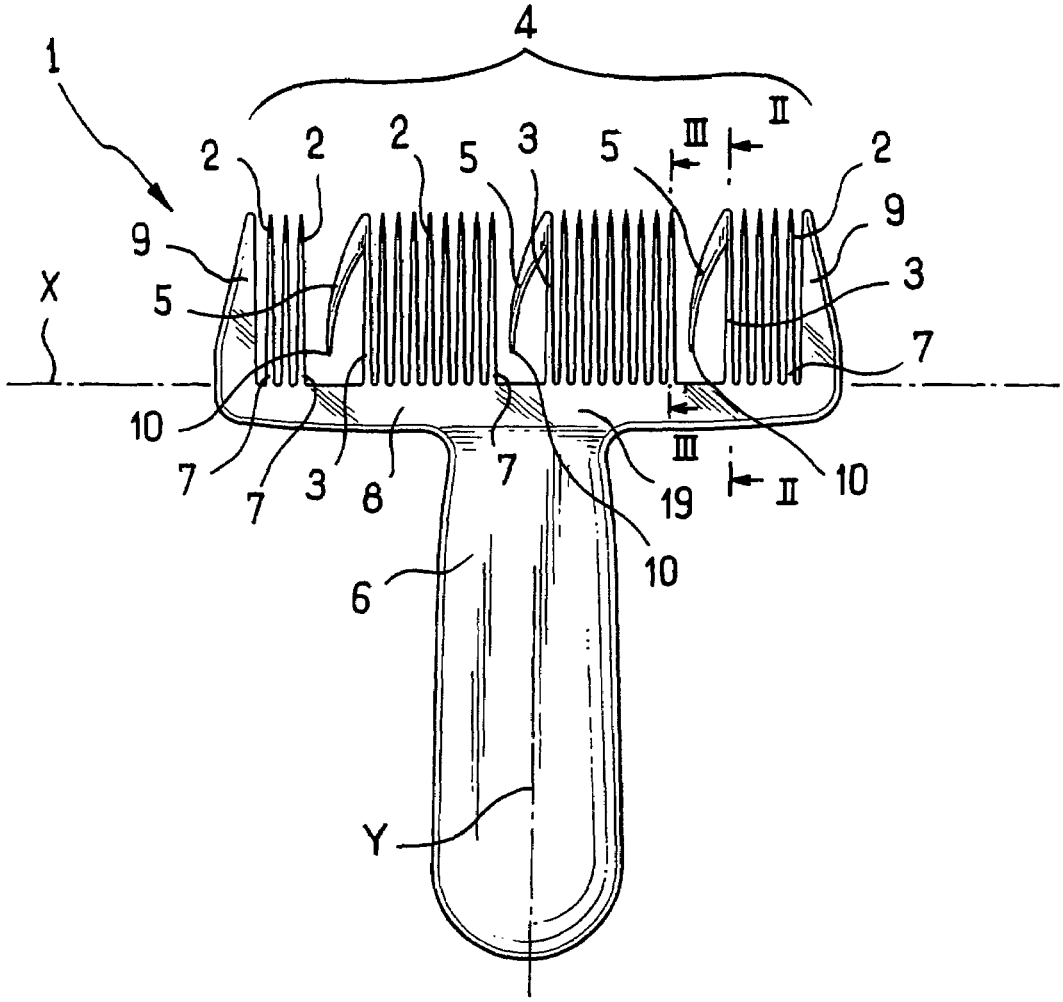
FIG. 1 is a diagrammatic elevation view of an exemplary comb.

The exemplary comb 1 shown in FIG. 1 comprises a succession 4 of regular teeth 2 and of teeth 3 that bear respective hooks 5. The succession 4 may generally extend along an axis X, that is straight in this example. At least one tooth does not form a hook. For example, the comb may have at least two teeth without hooks.

As shown in FIG. 1, the comb 1 may also include a handle 6 that projects along a longitudinal axis Y, for example, that is perpendicular to the axis X.

In the example shown, the teeth 2 and 3 have bases 7 that are in alignment along the axis X. The bases are attached to a back 8. The back at its central portion 19 may be secured to the handle 6.

For example, the entire comb 1 may be made as a single item by molding a plastics material, although it would not go beyond the ambit of the invention for other materials, such as metals, to be used.

Figure 3:
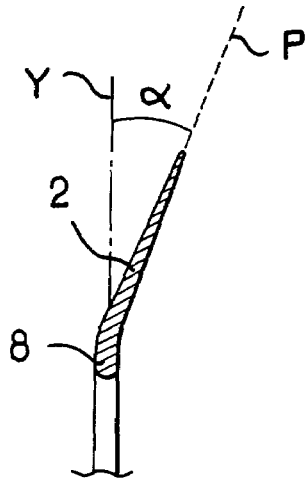
FIG. 3 is a fragmentary and diagrammatic cross-section taken on line III—III of FIG. 1.

FIG. 3 shows that the regular teeth 2 may lie in a plane P that may make a non-zero acute angle $\alpha$ with the longitudinal axis Y of the handle 6. The angle $\alpha$ may lie in a range of about 5° to about 45°, for example.

The back 8 may lie in the plane of the handle 6, as in the example shown, or, for example, may lie in the plane P by the central portion 19 forming an angle with the handle 6.

Figure 4:
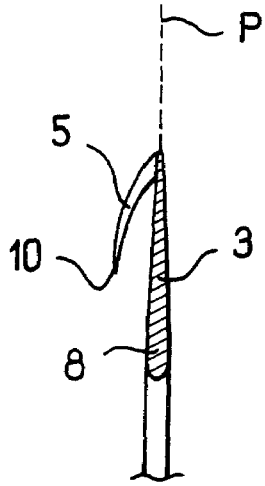
FIG. 4 is an identical view to FIG. 2 showing another exemplary comb.

If necessary or desirable, the teeth 2 and 3 may extend parallel to the longitudinal axis Y of the handle 6, as shown in FIG. 4.

Preferably, lateral ends 9 of the back 8 may have a same orientation as the teeth 2.

Figure 2:
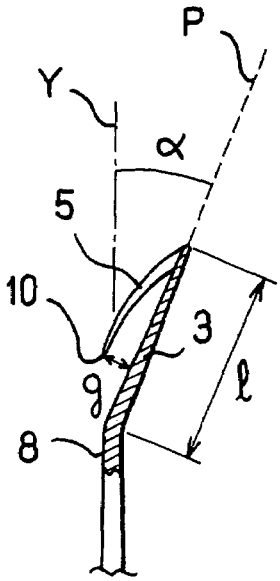
FIG. 2 is a fragmentary and diagrammatic cross-section taken on line II—II of FIG. 1.

The teeth 3 may lie in the same plane P as the teeth 2, and the entire length of each hook 5 may lies on one side of the plane P, for example, on the same side as the angle $\alpha$, as shown in FIG. 2, said hooks being directed both toward the back 8 and toward the same one of the lateral ends 9 of said back.

As shown, each hook 5 may have a generally curved shape, and may also be thinner toward a free end 10 thereof. Each hook 5 may be slightly concave toward the tooth 3 which bears the hook 5.

Figure 7:
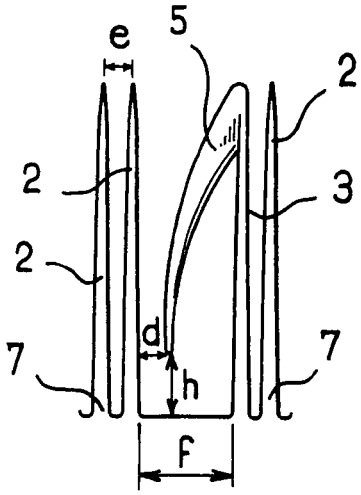
FIG. 7 shows a detail of FIG. 6 on a larger scale.

When the comb 1 is observed in an elevation or face view, as in FIGS. 1 and 7, the free end 10 of a hook 5 may appear to lie at a relatively small distance h from the back 8. The apparent distance h may corresponding to less than one fourth of the length l of the tooth which bears the hook, for example.

Since the hook 5 lies outside the plane P, when its free end 10 is observed parallel to the plane P, as shown in FIG. 2, said free end 10 may appear to be situated at a non-zero distance g from the tooth 3 that bears the hook.

The hook 5 may be relatively long, which makes the hook 5 flexible, thereby improving comfort in the event of contact with the scalp, and also enabling the hook 5 to retain a lock of hair adequately.

When the comb is observed in an elevation or face view, as in FIGS. 1 and 7, the apparent spacing d between the free end 10 of a hook 5 and the closest regular tooth 2 may correspond substantially to an average spacing e between two regular teeth 2, for example, as measured at their tips.

Of course, the invention is not limited to any particular values for h and/or d.

The regular teeth 2 may be grouped together in bunches of at least three teeth each, for example, as shown in FIG. 1. The bunches may be separated by the teeth 3 that bear the hooks 5.

In the example shown, within a group of teeth 2, all the bases 7 of the teeth 2 are arranged at regular intervals along the axis X. However, the bases 7 could be arranged differently without departing from the ambit of the invention.

The spacing f between the base 7 of a tooth 3 and the group of teeth 2 that is adjacent to the free end 10 of the hook 5 may correspond to about three or four times the average spacing e between the free ends of two teeth 2 in a group of teeth 2, for example, as shown in FIG. 7.

In the example shown, the comb 1 has three teeth 3 provided with respective hooks 5. However, the comb could have some different number of teeth 3.

In order to use the comb 1, the hair may initially be combed with the teeth 2 and 3 being held substantially perpendicular to the scalp.

Figure 5:
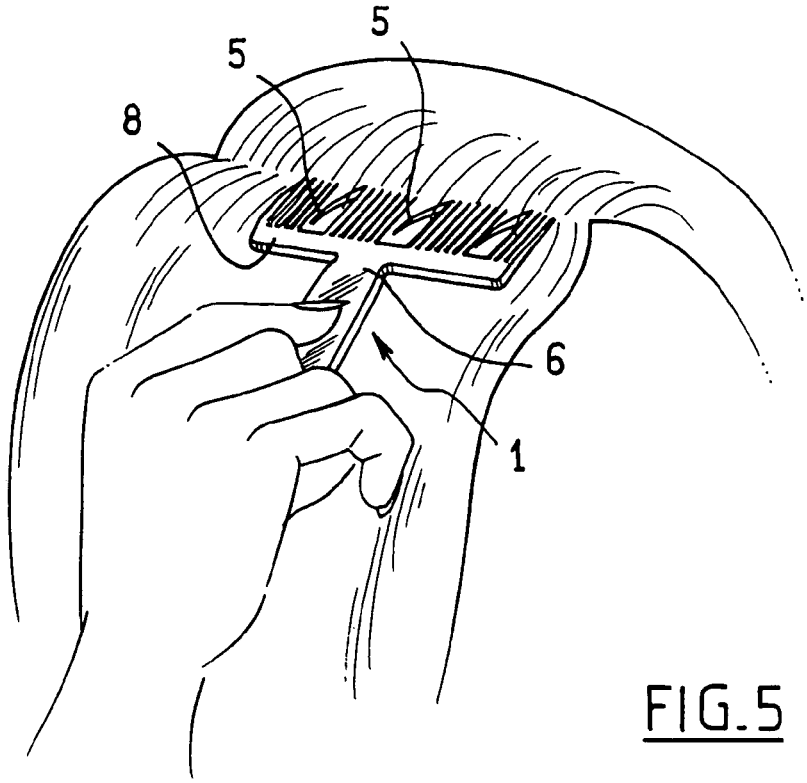
FIGS. 5 and 6 show how the exemplary comb in FIG. 1 may be used to isolate locks of hair.
Figure 6:
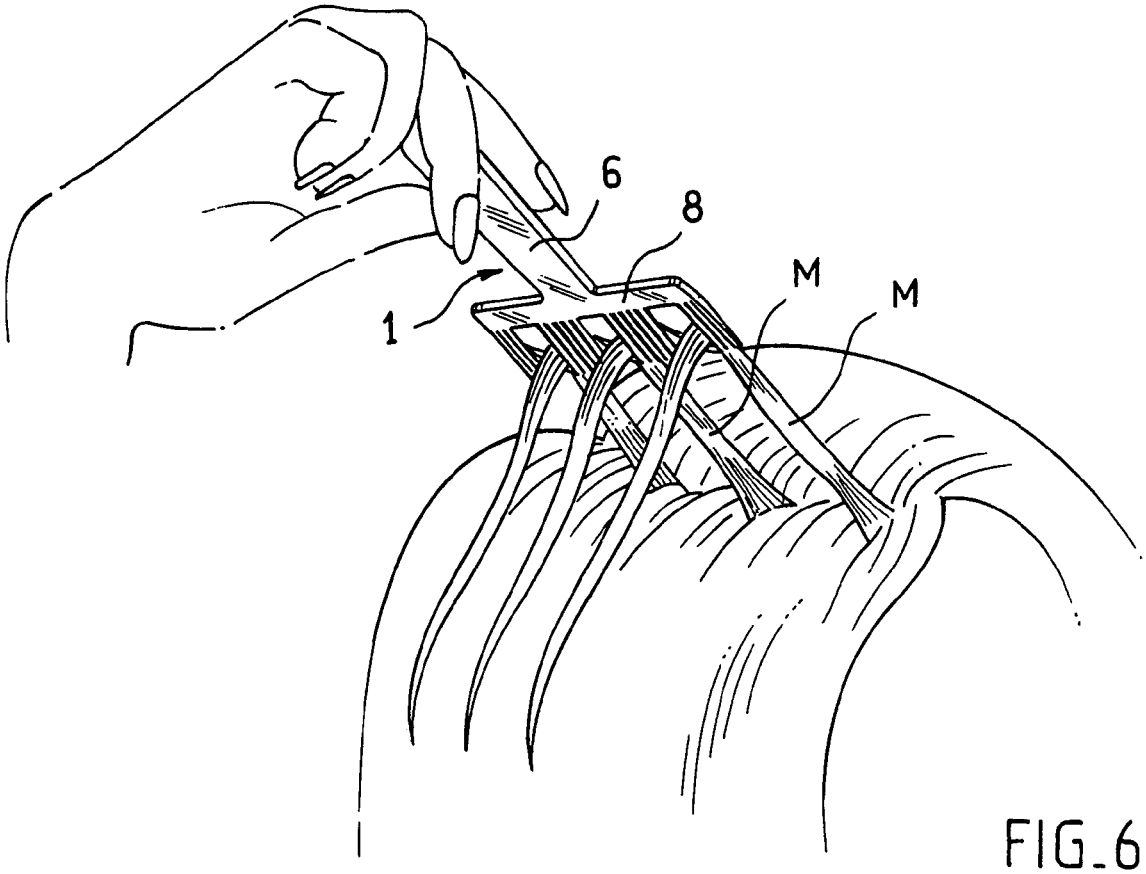

In order to extract the locks of hair, the teeth 2 and 3 may be placed substantially flat down on the head, as shown in FIG. 5, and the comb may be moved by drawing the handle 6 in such a manner that the locks M become engaged in the hooks 5, so that by subsequently lifting up the comb, as shown in FIG. 6, the locks M captured in the hooks 5 are isolated.

The locks M of hair thus extracted may be treated by application of a dye or a highlighter, for example. The locks may also be subjected to physical treatment such as exposure to laser irradiation, thereby destroying the melanin in said locks of hair, in order to bleach the locks of hair.

Figure 8:
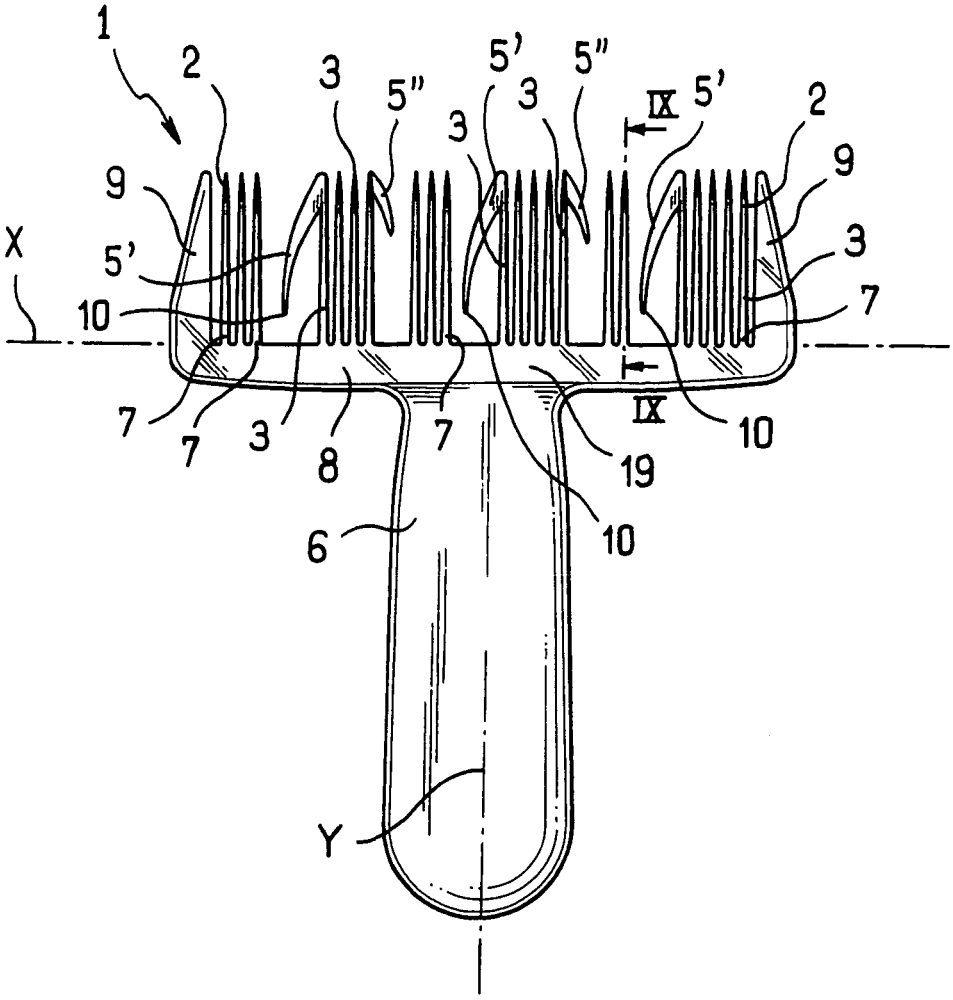
FIG. 8 is a diagrammatic elevation view of an exemplary comb.
Figure 9:
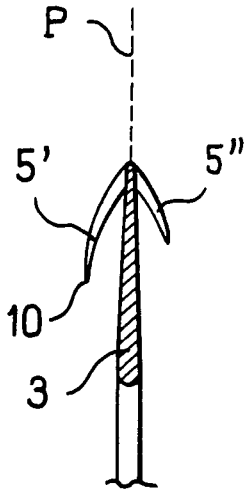
FIG. 9 is a fragmentary and diagrammatic cross-section taken on line IX—IX of FIG. 8.

In the example shown in FIGS. 8 and 9, the comb 1 has two succession of hooks 5' and 5" arranged respectively on either side of the plane P. The hooks 5' and 5" may be identical or different, as in the example shown. For example, the hooks 5" may be shorter than the hooks 5'. The spacing between two adjacent hooks 5' may be different from the spacing between two adjacent hooks 5", which may enable the user, for example, depending on which side of the comb is selected for application to the hair, to catch hold of a greater or lesser number of locks of hair or a larger or smaller quantity of hair per lock, depending on the spacing between the hooks, and on the size and shape of said hooks.

In the example shown in FIG. 8, all of the hooks 5' are directed toward a lateral end 9 of the back 8, whereas the other hooks 5" are directed toward the other lateral end 9 of the back 8, said hooks 5' and 5" extending away from the plane P, as shown in FIG. 9.

It should be understood that the hooks 5" may extend away from the plane P and toward the same lateral end 9 of the back 8 as the hooks 5'.

It should also be understood that the comb may include hooks which lie in the plane P in addition to hooks which extend away from the plane P.

Of course, the invention is not limited to the examples described above.

For example, the comb may assume another shape. Further, for example, the succession of teeth may extend along an axis X which is not straight, but which is curved, e.g., along a curve that matches the curve of the skull.

Moreover, the teeth 2 or 3 need not all have the same length or the same shape.

The handle 6 need not be straight and may extend generally perpendicularly to the bases of the teeth 2 and 3.

In any description, including the claims, the expression "including a" should be understood as being synonymous with "including at least one", unless specified to the contrary.

Although various details have been described with reference to particular embodiments, it is to be understood that these embodiments are merely illustrative of the principles and applications of the present invention. It is therefore to be understood that numerous modifications may be made to the illustrative embodiments and that other arrangements may be devised based on the foregoing disclosure.

What is claimed is:

1. A hair comb comprising:

a succession of teeth extending along an axis, the succession having:

at least one tooth that bears a hook, the hook extending laterally toward one lateral end of the comb and at least in part beyond a plane that is defined by at least two teeth in the succession; and at least two teeth without hooks, the hook including a free end that is axially spaced with respect to a closest consecutive tooth in the succession by a non-zero distance.

2. A comb according to claim 1, wherein the succession of teeth comprises at least two teeth each of which bears a hook.

3. A comb according to claim 2, wherein the hooks lie on a side of the succession of teeth.

4. A comb according to claim 2, wherein all the hooks extend laterally toward one lateral end of the comb.

5. A comb according to claim 1, wherein the succession of teeth comprises at least three teeth each of which bears a hook.

6. A comb according to claim 1, wherein the teeth have bases that are in alignment.

7. A comb according to claim 1, wherein a base of at least one tooth that bears a hook is separated from a base of a consecutive tooth without a hook by a distance that is at least twice an average spacing between tips of two teeth without hooks.

8. A comb according to claim 1, wherein a base of at least one tooth that bears a hook is separated from a base of a consecutive tooth without a hook by a distance that is at least three times an average spacing between tips of two teeth without hooks.

9. A comb according to claim 1, comprising a handle that projects along a longitudinal axis, the succession of teeth extending across the longitudinal axis.

10. A comb according to claim 9, wherein the succession of teeth extends along an axis that is perpendicular to the longitudinal axis.

11. A comb according to claim 9, wherein the succession of teeth comprises bases that extend along a plane that makes a non-zero acute angle with the longitudinal axis of the handle.

12. A comb according to claim 11, wherein the non-zero acute angle lies in a range of about 5° to about 45°.

13. A comb according to claim 11, wherein at Least one hook lies on a same side as the non-zero acute angle.

14. A comb according to claim 1, comprising a first succession of hooks that lie on one side of said plane and a second succession of hooks that lie on an opposite side of said plane.

15. A comb according to claim 14, wherein the hooks of the first succession are all directed toward a same lateral end of the comb and the hooks in the other succession are directed toward an opposite lateral end.

16. A comb according to claim 15, wherein a spacing between two adjacent hooks within the first succession is different from a spacing between two adjacent hooks within the second succession.

17. A hair comb comprising:

a succession of teeth, the succession having at least one tooth that bears a hook, said hook extending laterally toward one lateral end of the comb, at least in part beyond a first plane that is defined by at least two teeth in the succession, and beyond a second plane which is perpendicular to said first plane, the tooth including a base and the hook including a free end, the free end being offset with respect to the base when the tooth is observed along an axis of the succession of teeth.

18. A comb according to claim 17, wherein the succession of teeth comprises at least two teeth each of which bears a hook.

19. A comb according to claim 18, wherein all the hooks extend laterally toward one lateral end of the comb.

20. A comb according to claim 18, wherein the hooks lie on a side of the succession of teeth.

21. A comb according to claim 17, wherein the succession of teeth comprises at least three teeth each of which bears a hook.

22. A comb according to claim 17, wherein the teeth have bases that are in alignment.

23. A comb according to claim 17, wherein a base of at least one tooth that bears a hook is separated from a base of a consecutive tooth without a hook by a distance that is at least twice an average spacing between tips of two teeth without hooks.

24. A comb according to claim 17, wherein a base of at least one tooth that bears a hook is separated from a base of a consecutive tooth without a hook by a distance that is at least three times an average spacing between tips of two teeth without hooks.

25. A comb according to claim 17, comprising a handle that projects along a longitudinal axis, the succession of teeth extending across the longitudinal axis.

26. A comb according to claim 25, wherein the succession of teeth extends along an axis that is perpendicular to the longitudinal axis.

27. A comb according to claim 25, wherein the succession of teeth comprises bases that extend along a plane that makes a non-zero acute angle with the longitudinal axis of the handle.

28. A comb according to claim 27, wherein the non-zero acute angle lies in a range of about 5° to about 45°.

29. A comb according to claim 27, wherein at least one hook lies on a same side as the non-zero acute angle.

30. A comb according to claim 17, comprising a first succession of hooks that lie on one side of said plane and a second succession of hooks that lie on an opposite side of said plane.

31. A comb according to claim 30, wherein the hooks of the first succession are all directed toward a same lateral end of the comb and the hooks of the second succession are directed toward an opposite lateral end.

32. A comb according to claim 31, wherein a spacing between two adjacent hooks within the first succession is different from a spacing between two adjacent hooks within the second succession.

33. A hair comb comprising a succession of teeth, the succession having at least two teeth that bear a hook, at least one of said hooks extending laterally toward one lateral end of the comb and at least in part beyond a plane that is defined by at least two teeth in the succession, said two teeth that bear a hook being separated by at least two teeth without hook, the at least one hook including a free end that is axially spaced with respect to a closest consecutive tooth in the succession by a non-zero distance.

34. A comb according to claim 33, wherein the succession of teeth comprises at least three teeth each of which bears a hook.

35. A comb according to claim 33, wherein the hooks lie on a side of the succession of teeth.

36. A comb according to claim 33, wherein all the hooks extend laterally toward one lateral end of the comb.

37. A comb according to claim 33, wherein the teeth have bases that are in alignment.

38. A comb according to claim 33, wherein a base of at least one tooth that bears a hook is separated from a base of a consecutive tooth without a hook by a distance that is at least twice an average spading between tips of two teeth without hooks.

39. A comb according to claim 33, wherein a base of at least one tooth that bears a hook is separated from a base of a consecutive tooth without a hook by a distance that is at least three times an average spacing between tips of two teeth without hooks.

40. A comb according to claim 33, comprising a handle that projects along a longitudinal axis, the succession of teeth extending across the longitudinal axis.

41. A comb according to claim 40, wherein the succession of teeth extends along an axis that is perpendicular to the longitudinal axis.

42. A comb according to claim 40, wherein the succession of teeth comprises bases that extend along a plane that makes a non-zero acute angle with the longitudinal axis of the handle.

43. A comb according to claim 42, wherein the non-zero acute angle lies in a range of about 5° to about 45°.

44. A comb according to claim 42, wherein at least one hook lies on a same side as the non-zero acute angle.

45. A comb according to claim 33, comprising a first succession of hooks that lie on one side of said plane and a second succession of hooks that lie on an opposite side of said plane.

46. A comb according to claim 45, wherein the hooks of the first succession are all directed toward a same lateral end of the comb and the hooks in the second succession are directed toward an opposite lateral end.

47. A comb according to claim 46, wherein a spacing between two adjacent hooks within the first succession is different from a spacing between two adjacent hooks within the second succession.

48. A method of dyeing or adding highlights to at least one lock of hair, the method comprising:

isolating at least one lock of hair by using the hair comb of claim 1; and treating the at least one lock thereby isolated.

49. A method according to claim 48, wherein the at least one isolated lock is treated through at least one of adding highlights and dyeing.

50. A method according to claim 48, wherein the comb is used to isolate a plurality of locks simultaneously.

51. A method according to claim 48, wherein isolating at least one lock of hair comprises:

combing the hair;

laying the comb against the hair, the hook being situated beside the scalp; and moving the comb in such a manner that at least one lock becomes engaged in the hook.

* * * * *